US005265880A

United States Patent [19]

Maksymec

[11] Patent Number: 5,265,880

[45] Date of Patent: Nov. 30, 1993

[54] BINGO GAME

[75] Inventor: Peter A. Maksymec, Las Vegas, Nev.

[73] Assignee: Esquire Ltd., Inc., Las Vegas, Nev.

[21] Appl. No.: 970,678

[22] Filed: Nov. 4, 1992

[51] Int. Cl.[5] ..... A63F 3/06

[52] U.S. Cl. ..... 273/269

[58] Field of Search ..... 273/269, 139, 138 R

[56] References Cited

U.S. PATENT DOCUMENTS

| | | | |
|---|---|---|---|
| 2,484,143 | 10/1949 | Arnold | 273/139 |
| 4,885,700 | 12/1989 | Kondziolka et al. | 273/269 |
| 5,074,566 | 12/1991 | Desbiens | 273/269 |
| 5,096,202 | 3/1992 | Hesland | 273/269 |

OTHER PUBLICATIONS

Apr. 1986 Bonanza Bingo.

Quick Shot Bonanza Bingo–Bingo King.

*Primary Examiner*—Benjamin H. Layno

*Attorney, Agent, or Firm*—Edward J. Quirk

[57] ABSTRACT

A "blackout" or "coverall" bingo game is played over a long duration, e.g., 24 hours. A fixed number (48–58) of bingo numbers are drawn from the pool of numbers at the beginning of the game and are posted or displayed for players to see. Players may acquire cards at any time during the play of the game and compare the cards with the winning numbers to see if the card is a winning card. Winning cards are paid off at a minimum of 1,000 times the purchase price. The card faces are invisible to the player upon purchase, and can be preprinted, printed by a random generator on demand, or be displayed on video screens.

31 Claims, No Drawings

BINGO GAME

FIELD OF THE INVENTION

This invention relates to a "blackout" game of bingo in which all of the winning numbers are drawn prior to distribution of the bingo cards, and players are able to acquire cards at any time during a fixed time period after the drawing. The players can then immediately compare the card with the drawn numbers to determine if they have a winning card.

BACKGROUND OF THE INVENTION

The game of bingo is a lottery game of chance which reportedly is played by more players in the United States than any other gambling game. The game originated over 200 years ago, and is played in many variations and under several names.

Bingo is typically played on a bingo card which contains twenty-five numbered squares laid out in a 5×5 grid. Each of the five vertical rows is centered under the letters B-I-N-G-O; seventy-five or ninety numbers are used, with numbers 1-15 being assigned to the first or "B" row, 16-30 to the "I" row, etc. The central square on the bingo card is a free number and is covered by a marker at the beginning of the game.

Winning numbers are selected from the group 1-75 or 1-90 by any of many random selection means. As each winning number is drawn, the player scans the card to determine if the number appears on his card, and covers the number if it does appear. The first player to achieve five markers in a row on the card is declared a winner.

Historically, bingo has been played as a parlor game, in movie theaters, for church and charity fundraisers, and as a gambling game in casinos. In recent years, in order to relieve the boredom of playing the same type of game over and over again, and to add variety and interest to the game, numerous variations of bingo have been developed. Many of these variations involve the achievement of goals different from the conventional one of five linear markers on the face of a card. For example, games can be played in which the winning configuration on the card resembles various letters of the alphabet, such as C, U, H, K, M, L, X, and T. Other variations include achievement of shapes resembling a diamond, picture frame, chair, bow tie, "happy face", anchor, and "jailhouse window" (three vertical rows). Another popular variation, which is often used to end an evening of bingo, requires the winner to completely cover all of the squares on the card; this version is known by numerous names including "jackpot", "coverall", and "blackout". In this version, numbers are called until a winner has been declared, with the payout to the winner decreasing with the total number of numbers called before the winning card is filled.

A type of coverall or blackout bingo game currently popular is known as "Bonanza Bingo". At the beginning of a bingo parlor session, fifty numbers are called and posted on the master scoreboard during the bingo session. Cards may be purchased during the session. During the last game of the evening, prize money for the Bonanza Bingo game will be calculated depending on the number of players (the house retaining a fixed percentage). If no winners appear on the first fifty numbers, the drawing continues for the 51st, 52nd, 53rd, etc. number until a winner is selected. After a winner appears, the game is over. If more than one winner exists in the first 50 numbers, the winner who appears in the smallest number of balls drawn prevails.

One of the limitations of Bonanza Bingo and other bingo games is that a large bingo hall is required for play of the game. In general, bingo games now played are relatively time, labor, and space intensive. Numerous players sit in a large space during the play of the game, and numbers for each separate game are drawn individually over a period of time until a winner occurs. The continuous draw of numbers require that at least one employee and a supervisor be involved with the draw at all times.

Need exists for a bingo-type game which need not be played by numerous players simultaneously in a large area, and which is less labor-intensive than existing games. In addition, there is a need for casino games in which large payouts can be made to players, and in which the win/lose result is determined quickly. In recent years, the advent of progressive jackpots for slot machines, in which a player can place a $1 bet in a machine and win many hundreds of thousands of dollars, has proven extremely popular. Large payouts have not been an incident of most bingo games.

Accordingly, it is an object of the present invention to provide a bingo game in which a player can acquire a bingo card, compare the card with predrawn numbers, and determine immediately if a prize has been won. It is another object of the invention to provide a "coverall" or "blackout" game which people can play at any time during a fixed time period, and for which the payoff for each winner is at least 1,000 times the cost of the card. These and other objects of the invention are provided by the improved bingo game described in detail herein.

SUMMARY OF THE INVENTION

A bingo game is provided which uses a conventional bingo card and in which at least 48 winning numbers are drawn prior to the sale or distribution of any bingo cards. After the initial draw, no further numbers are drawn. The winning numbers are displayed during the entirety of a fixed time period during which the game may be played by multiple players. Play need not be simultaneous, but can occur at any time during the fixed time period.

Upon purchase of a card, a player opens the card and compares the numbers on the card with the preselected winning numbers. Should the winning numbers cover the entire card of the player, the player may immediately cash in the card for an amount which is at least 1,000 times the purchase price of the card, and preferably more. Winning cards are paid immediately. An unlimited number of players may play during the fixed time period of the game, and an unlimited number of winners may be paid on the same game.

DETAILED DESCRIPTION OF A PREFERRED EMBODIMENT

In a preferred embodiment of the game, standard bingo cards having 25 square with a free space in the middle are used. Since the winning numbers are preselected at the beginning of each game, sealed cards are used. Sealed cards do not permit anyone to see the numbers on the face of the card until the card has been purchased and the sealed envelope opened. Typically, the sealed cards are identified by the manufacturer with a library number and set number, as later described, and may be further identified by a series of holes punched through the card which form the day, month, and year on which the card is issued. The house may also stamp the card with its own identifying mark, including the game number and the date and time issued, as well as a sequential number, to prevent a card sold for one particular game from being used in a later game. These identifying marks or symbols are conventional in the bingo art and are used to preclude cheating by either identifying the winning card in advance of the game, counterfeiting a card, or reusing an expired card. Suitable commercially available cards for use in the game of the invention are "Bonanza Bingo" cards manufactured by Bingo King Company of Hollywood, Fla.

In a casino environment, one game is played during a predetermined fixed time period. The time period is set by the house. This period may be an eight-hour shift, 12-hour shift, a 24-hour day, or a longer or shorter time (e.g., one to four hours per game). The game is played with a standard 25-spot card, with numbers called from a 75-number set of bingo balls or other random selection device. At the beginning of the time period, at least 48, preferably at least 50, and still more preferably 55 numbers are drawn and posted. No additional numbers will be drawn during the entirety of the contest. Any type of random selection device for the numbers, including a random number generator or roulette-wheel type of selector, may be used; typically, bingo balls, which are numbered ping pong balls pulled from an air-blown vessel, are the most popular selection device. While 55 numbers are preferably drawn, as few as 48 numbers and as many as 58 numbers may be drawn, with variations in the payouts being made to provide a guaranteed profitable return to the house.

During the fixed time period for each game, conventional sealed bingo cards are sold to players upon demand. A player will be able to see all of the posted numbers prior to purchasing a card, and may be able to determine if a "lucky" number or combination exists in the displayed numbers. Upon purchasing a card, the player may immediately open the card, compare the numbers on the card with the winning numbers, and present a winning card for collection. If one game is played each day, any number of players may walk up to a card purchase window at any time during the day, purchase one or more cards, compare the numbers to the winning numbers, and collect a winning ticket. It is not necessary to have a large bingo hall or room in which the game is played, nor is it necessary to have separate personnel to draw and verify the numbers selected for numerous games during the day. A single drawing is made and verified at the beginning of the day, and new numbers are not drawn until the beginning of the next day (or other selected time period). The game could be operated as an adjunct to an existing keno game, thereby requiring no additional personnel or space. Since the cost of operating the game is minimal, the game of the invention is far more profitable to a casino than conventional bingo games, which are generally very low profit ventures.

The number of balls (or other random selection means) which are drawn is preferably 55. Most bingo players are conditioned to believe that the probability of covering all 25 numbers on a bingo card from a pool of 55 winning numbers drawn (out of 75 total) is quite good. In fact, the probability is approximately 10,000:1. Nonetheless, from the house's standpoint, a large prize may be given for anyone that wins the game after 55 numbers have been drawn. In order for the game to be attractive to players, a payout of at least 1,000:1, preferably 2,000:1, and more preferably 5,000:1 can be made based on the cost or consideration paid for the card, or in the event of a free or promotional game provided by the house, a minimum payout of $500. An alternative measure of the payout is that for a free game it should be a dollar amount at least 20% of the odds of a player achieving a successful result in the game with one card. In other words, if the odds of winning are 10,000:1, the payout must be at least 20% of $10,000 or at least $2,000. With payouts exceeding 1,000:1, a large number of players are attracted to the game who would otherwise not be interested in playing a bingo game. The minimum payout depending on the number of bingo balls selected at the beginning of the game can vary substantially, with the payout increasing significantly if the number of balls drawn is less than 55. Minimum suggested payouts may be as follows:

| Numbers Selected | Minimum Payout | Preferred Minimum Payout |
|---|---|---|
| 48 | at least 50,000:1 | at least 100,000:1 |
| 49 | at least 25,000:1 | at least 50,000:1 |
| 50 | at least 10,000:1 | at least 20,000:1 |
| 51 | at least 5,000:1 | at least 10,000:1 |
| 52 | at least 2,500:1 | at least 5,000:1 |
| 53 | at least 2,000:1 | at least 4,000:1 |
| 54 | at least 1,500:1 | at least 3,000:1 |
| 55 | at least 1,000:1 | at least 2,000:1 |
| 56 | at least 500:1 | at least 1,000:1 |
| 57 | at least 250:1 | at least 500:1 |
| 58 | at least 100:1 | at least 200:1 |

The high payout levels will be particularly attractive to players who enjoy playing games that have a potential very large payback.

The object of the game of the invention is to cover all of the spots on a 25-number bingo card. However, it is also possible to play the game covering, for example, 24 of the 25 spots and still achieve a large payout. While this is not preferred, a 24-spot coverage game is substantially equivalent to the game of the invention for the purpose of providing an exciting game with a relatively large payout. It is not as preferred as the "blackout" game, however, because the very large potential payout of the blackout game is particularly attractive to the player.

While a 55-ball draw is preferred in order to provide a good balance of a large payout with a perceived reasonable opportunity to win, from a marketing standpoint it may sometimes be desirable to mix various games. For example, a 55 ball draw with a payout of $1,200 may be followed by a 52 ball draw game in which a much larger payout, e.g., $25,000, may be awarded. Alternatively, a casino could run two or more games simultaneously, such that a player could select the combination of number of balls drawn and payout which are most appealing to him. The flexibility of the games of the invention is particularly attractive to both the house and the player; the player can play as many cards as he desires and instantly determine if any are winners, and the house can service many hundreds of players over the course of a day with little or no additional personnel. The game need not be played in conjunction with another bingo game, but can be run independently or in combination with keno, a race and sports book, or any other function within a full service casino or bingo hall. Indeed, the game could be played from the counter of a restaurant or delicatessen, or sold by a keno runner. Because the board can be displayed electronically throughout a hotel or casino, the game can be played at remote locations in the same manner as keno.

The cards which are sold for use in the game of the invention should be sold or otherwise provided in a sealed package and with sufficient identification indicia to preclude counterfeiting or unauthorized reuse. As indicated previously, cards usable in the invention are readily commercially available. Most bingo cards are preprinted disposable paper sheets which have identification markings in accordance with a library code and which are packaged in a sealed container such that the numbers are not visible from the exterior of the package. Once the seal is broken, the player has access to the face of the card which carries the numbers. Typically, the face of the card carries a 4- or 5-digit identifying number which correlates to a specific unique card number pattern, and the exterior of the package contains a printed serial number or other identifying marking which may be printed by the user according to its own identification system. In addition, the card is date- and time-stamped such that when the original game for which the card is sold has been completed, it cannot be reused.

One manner in which the paper cards are commonly marked is by punching the time and date of the card through the card, ensuring the counterfeiting would not be possible. Alternatively, stamping the card with a game number, time and date is effective. The particular security means for identifying the card is not a feature of the invention, although the existence of security identification means for precluding use of the cards in subsequent games is absolutely essential to the successful operation of the claimed game. Alternatively, the cards can be identified by an identifying game number which can be stamped on the cards prior to drawing. The number of the particular game being played will be prominently displayed throughout the establishment and during the period in which that game is being played, the cards sold for that game will be marked with that number. Of course, cards may also be sold for future games and will be identified by the future game number.

The cards of the invention can be prepackaged, printed cards as previously described, or can be issued by machine. Preprinted cards may be dispersed from a machine in a manner similar to other vending machines, or cards can actually be printed by the machine upon demand. For example, a card-issuing machine could receive coins or paper currency and, by laser jet printer, complete the printing of the numbers in the squares according to a computerized, random selection system. The card would also be identified by coded markings, such as date, time, and game number, to ensure the integrity of the game.

In another embodiment, the "cards" could be available by video terminal. Instead of being issued a printed card, the player would participate in the game in the same manner as the play of a video game, such as a video poker machine. Upon payment of the appropriate playing fee, which could be e.g. $1-5, the video screen would display the bingo card with numbers randomly selected according to appropriate software instructions. Coverall would be detected through linkage to a central processing unit, and a "win" would be signaled at the terminal and at the central unit.

The most important characteristic of the card is that the face of the card be invisible to the player prior to purchase. This can be accomplished in any of the foregoing manners. The term "card" is not limited to a printed product, but can include a computer or video display as described above.

The game of the invention is distinguished from other games also in that it has an unlimited number of winners in each time period during which the game is conducted.. Other bingo games play until there is a winner. Once a winner is obtained, the game is over. In the game of the invention, after the initial draw of numbers, no further numbers are drawn, but play of the same game continues for many hours.

Numerous variations and modifications can be made in the game and within the inventive concept as set forth in this disclosure. Accordingly, the game should be considered limited not by the preferred embodiments previously disclosed, but rather by the following claims.

I claim:

1. A method of playing a game of bingo comprising the steps of at the beginning of a predetermined fixed time interval, randomly selecting and displaying a predetermined quantity of winning indicia from a fixed pool of potential winning indicia, once said predetermined quantity of indicia is selected and displayed, terminating the selection of any more winning indicia during said time interval, permitting players to acquire, for a consideration, conventional bingo cards at any time after the predetermined quantity of winning indicia is selected and displayed during the predetermined fixed time period, the faces of said cards having indicia on playing spots thereon and being invisible to the players prior to the players acquiring the cards, continuing to display the same winning indicia during the predetermined fixed time interval, said winning indicia remaining unchanged during said time interval, enabling players to compare the indicia on the distributed bingo cards with the winning indicia immediately upon acquisition of the cards to determine if the cards are winning cards, a winning card being determined if all of the indicia on the playing spots of the card match winning indicia, paying players a payout of at least 1000 times the value of the consideration paid by a player for each winning card, and permitting said players to collect said payout immediately upon determination that they hold a winning card, stopping the distribution of said bingo cards after completion of the fixed time interval, randomly selecting a second plurality of winning indicia from the same fixed pool of potential winning indicia, and repeating the play of a new game for a second fixed time interval.

2. The method of claim 1 in which the plurality of winning indicia is at least 48 winning indicia.

3. The method of claim 1 in which the plurality of winning indicia is at least 50 winning indicia.

4. The method of claim 1 in which the cards distributed to players are preprinted cards, each of which is individually marked with identification markings to preclude counterfeiting of cards.

5. The method of claim 1 wherein each card is permanently marked with a time of expiration of the card.

6. The method of claim 1 in which preprinted cards are packaged in sealed packages.

7. The method of claim 1 in which the payout is at least 2,000 times the value of the consideration of each winning card.

8. The method of claim 1 in which not more than 52 indicia are selected and the payout is at least 5,000 times the value of the consideration of each winning card.

9. The method of claim 1 in which the time interval during which a single game is played is at least 1 hour.

10. The method of claim 1 in which the time interval during which a single game is played is at least 4 hours.

11. The method of claim 1 in which the time interval during which a single game is played is at least 8 hours.

12. The method of claim 1 in which the time interval during which a single game is played is at least 12 hours.

13. The method of claim 1 in which the time interval during which a single game is played is at least one day.

14. The method of claim 1 in which cards are machine printed upon demand by a player, indicia on the cards being selected by random selection means.

15. The method of claim 1 in which cards are displayed on a video terminal.

16. The method of claim 15 in which 55 winning numbers are selected.

17. The method of claim 15 in which 54 numbers are selected and the payout is at least 1,500 times the value of the consideration paid by a player for each winning card.

18. The method of claim 15 in which 53 numbers are selected and the payout is at least 2,000 times the value of the consideration paid by a player for each winning card.

19. A method of playing a game of bingo comprising the steps of at the beginning of a predetermined fixed time period, randomly selecting and displaying not less than 48 and not more than 58 winning numbers from a fixed pool of potential winning numbers, once said predetermined quantity of winning indicia is selected and displayed, terminating the selection of any more winning indicia during said time period, continuing to display the winning numbers to prospective players for the duration of the fixed time period during which the play of the same game will continue, said winning numbers remaining unchanged during said time period, during the entire predetermined fixed time period after the predetermined quantity of winning indicia is selected and displayed, distributing conventional bingo cards to players upon said players' requests and for consideration, the faces of said cards being invisible to said players prior to distribution to said players, enabling players to compare, at any time following selection of the winning numbers, numbers on the cards with the winning numbers immediately upon acquisition of the cards to determine if the cards are winning cards, a card being a winning card if all numbers on the player's card match winning numbers, paying each player having a winning card a payout of at least 1,000 times the value of the consideration paid by the player for said card, payment being made upon the player's request at any time after determination that a card is a winning card, and stopping the distribution of said bingo cards after completion of the fixed time period, randomly selecting from 48 to 58 winning numbers from the same fixed pool of potential winning numbers and repeating play of a new game for a second fixed time period.

20. The method of claim 17 in which no consideration is paid for the card and the payout is at least $500.

21. The method of claim 17 in which no consideration is paid for the card and the payout is a dollar amount at least 20% of the odds of a player winning the game with one card.

22. The method of claim 17 in which 52 numbers are selected and the payout is at least 2,500 times the value of the consideration paid by a player for each winning card.

23. The method of claim 17 in which 51 numbers are selected and the payout is at least 5,000 times the value of the consideration paid by a player for each winning card.

24. The method of claim 17 in which 50 numbers are selected and the payout is at least 10,000 times the value of the consideration paid by a player for each winning card.

25. The method of claim 17 in which the time period during which a game is played is at least 1 hour.

26. The method of claim 17 in which the time period during which a game is played is at least 4 hours.

27. The method of claim 17 in which the time period during which a game is played is at least 8 hours.

28. The method of claim 17 in which the time period during which a game is played is at least 12 hours.

29. The method of claim 17 in which the time period during which a game is played is at least 24 hours.

30. The method of claim 17 in which cards are displayed on video terminal screens.

31. A method of playing a game of bingo comprising the steps of randomly selecting and displaying at the beginning of the game a predetermined quantity of between 48 and 58 winning numbers from a fixed pool of potential winning numbers, displaying the winning numbers to prospective players for the duration the same game will continue, said duration being at least 8 hours, once said predetermined quantity of winning numbers is selected and displayed, terminating the selection of any more winning numbers during said duration, distributing, for consideration, conventional bingo cards to players, said conventional bingo cards having faces comprising twenty-four numbers which are included in the fixed pool of potential winning numbers, the faces of said cards being invisible to potential players prior to distribution of the cards to said players, distribution of said cards occurring upon request by players at any time after the predetermined quantity of winning indicia is selected and displayed during the duration of the game, enabling players to compare, at any time following selection of the winning numbers and immediately upon a player's acquisition of cards, the distributed cards with the winning numbers to determine if the cards are winning cards, a winning card being determined if all twenty four numbers on the face of the card are winning numbers, paying each player having a winning card a payout of at least 1,000 times the value of the consideration paid by the player for said card, payment being made immediately upon determination that a card is a winning card, and stopping the distribution of said bingo cards after completion of the duration of the game, randomly selecting from 48 to 58 winning numbers from the same fixed pool of potential winning numbers and repeating play of a new game for a similar duration.

* * * * *